United States Patent [19]
Vasiliev et al.

[11] Patent Number: 4,475,587
[45] Date of Patent: Oct. 9, 1984

[54] HEAT EXCHANGER

[75] Inventors: Boris P. Vasiliev; Nikolai L. Borisov; Mikhail K. Semenov; Ivan K. Ponomarev; Galina B. Tyryshkina; Igor V. Gorbatenko, all of Belgorod, U.S.S.R.

[73] Assignee: Belgorodsky Zavod Energeticheskogo Mashinostroenia, U.S.S.R.

[21] Appl. No.: 316,875

[22] Filed: Oct. 30, 1981

[51] Int. Cl.³ ..... F28F 9/22
[52] U.S. Cl. ..... 165/140; 165/145; 165/81; 165/DIG. 27
[58] Field of Search ..... 165/140, 145, 81, DIG. 27

[56] References Cited

U.S. PATENT DOCUMENTS

| | | | |
|---|---|---|---|
| 1,123,201 | 12/1914 | Almirall | 165/140 |
| 1,782,394 | 11/1930 | Beimling | 165/140 |
| 2,750,159 | 6/1956 | Ebner | 165/103 |
| 3,483,920 | 12/1969 | Heyn et al. | 165/165 |

FOREIGN PATENT DOCUMENTS

| | | | |
|---|---|---|---|
| 0544380 | 6/1956 | Italy | 165/140 |

*Primary Examiner*—William R. Cline
*Assistant Examiner*—John F. McNally
*Attorney, Agent, or Firm*—Steinberg and Raskin

[57] ABSTRACT

In a heat exchanger having tubes arranged in latticed pattern in a frame and serving to conduct a medium for heat exchange and enclosed in a housing wherein the space defined by the housing and the frame is divided into a collector and a distribution chambers, each chamber being subdivided with a partition wall defining a further chamber, namely a collector and a distribution chambers respectively. These chambers intercommunicate through corresponding tubes to form separate flow paths for the medium for heat exchange. The heating or cooling medium is flowing through the exchanger transversely to the longitudinal direction of the tubes.

8 Claims, 4 Drawing Figures

HEAT EXCHANGER

BACKGROUND OF THE INVENTION

1. Field of the Invention

This invention relates to heat exchangers and particularly to a heat exchanger having tubes which are arranged in a latticed pattern and serve to conduct the medium that is to be heated or cooled, the ends of the tubes being held in end walls, and another medium for heat exchange is flowing through the exchanger transversely to the longitudinal direction of the tubes.

Apart from a variety of applications of exchangers of the class described the present invention contemplates utilization of such a heat exchanger with a vertically moving compact bed of heat-transfer media, for example, in the recovery of heat from shale ashes in a process for the continuous retorting of oil shale or for a recuperative heating of granular materials by a gas flowing through the exchanger.

2. Description of the Prior Art

A heat exchanger of the class described is disclosed in U.S. Pat. No. 3,483,920. The heat exchanger comprises tubes arranged in side-by-side planes and serving to conduct a fluid for heat exchange, the tubes in one plane being transverse to those of the other plane. The ends of the tubes are held in side walls of a frame open at two sides transverse to the side walls to form an inlet and outlet for the medium that is to be heated or cooled. The frame is enclosed by a housing having an inlet and outlet for the fluid for heat exchange. The frame is engaged with the housing to form with the housing walls and the side walls of the frame a collector and a distribution chambers intercommunicating via the tubes to provide a flow path for the fluid for heat exchange. One embodiment comprises the frame and the housing held together by means of W-shaped holders, which serve as partitions to divide the housing inner space into a collector and a distribution chambers. In this embodiment the frame holding the tubes is box-shaped while the housing is of a drum-type construction.

The prior-art exchanger provides a flow path for but only one fluid. To heat or cool more than one fluid flow simultaneously it is necessary to use a corresponding number of heat exchangers, which naturally leads to extra floor for the exchangers and if use is made of a building-block exchanger units, they each still have dimensions that are to be considered.

The prior-art exchanger is constructed for two media in heat exchange, namely, a gas and liquid, which gas and liquid may be both a heated or cooled medium, and a gas is conducted through the frame and a liquid along the flow path defined by the collector and the distribution chambers and by the tubes. The flow path defined by the collector and the distribution chambers and by the tubes when used for conducting a gas at a high speed in the heat exchanger constructed according to the teachings of th U.S. Pat. No. 3,483,920 causes an uneven distribution of the gas among the tubes and, consequently, an unsatisfactory heat exchange, since the cross-sectional areas of both the collector and the distribution chambers is small as compared to that of the tubes. This problem is of particular importance in the case of utilizing the prior-art exchanger with a vertically moving compact bed of heat-transfer media, for example, in the recovery of heat from shale ashes in a process for the continuous retorting of oil shale.

SUMMARY OF THE INVENTION

An object of the present invention is to provide a heat exchanger enabling a simultaneous heating or cooling of several fluid flows to a design temperature and constructed substantially to overall dimensions of a heat-exchanger for cooling or heating one medium.

A further object of the invention is to provide a heat exchanger enabling a simultaneous heating or cooling of several fluid flows by a vertically moving compact bed of heat-transfer media and at elevated pressures.

A still further object of the invention is to provide a heat exchanger comprising a plurality of tubes arranged in a latticed pattern and enclosed in a housing having an inlet and outlet for a gas flowing through the exchanger at a high speed and enabling a more even than heretofore distribution of the gas among the tubes and, consequently, an improved heat transfer.

These and other objects of the present invention are attained in a heat exchanger comprising a plurality of tubes arranged in at least two side-by-side planes to carry at least one fluid for heat exchange, the tubes in one plane being transverse to those of the other plane. The ends of the tubes are held in the side walls of an elongate frame open at two sides to form an inlet and outlet for the medium that is to be heated or cooled. The frame is enclosed in a housing having an inlet and outlet for the fluid for heat exchange. The frame is engaging the housing in a manner to form between the housing walls and the side wall of the frame a collector and a distribution chambers intercommunicating via the tubes.

The invention resides in that the collector and the distribution chambers are each divided by partition walls into at least two chambers to thereby form at least two collector chambers and at least two distribution chambers, each collector chamber communicating with a corresponding distribution chamber through corresponding tubes.

Due to the partition walls, which separate a portion of the tubes to provide a separate heat exchange surface the novel heat exchanger enables heating or cooling more than one fluid, the fluids involved may be of the same kind or different, as well as they may be under different or similar conditions, for example, temperature, pressure or speed. As compared to a group of heat exchangers for heating or cooling one medium in each exchanger, the heat exchanger of the invention enables to solve the problem with simpler structural means and by using a lesser amount of material.

When the heat exchanger of the invention is used for heating or cooling a gas in a vertically moving compact bed of heat-transfer media the heat exchange process is possible at elevated pressure. To provide the heat-exchange equipment with the ability to withstand an inner superatmospheric pressure, while using a lesser amount of structural materials, the partition walls are preferably made semicylindrical or arcuate in cross section.

Also, due to the fact that the partition walls are arranged in the chambers, namely, collector and distribution chambers, there is no need for stringent requirements to the strength and rigidity of the partition walls, since the latter are in the fluid or the fluid passes over their surfaces at both sides therefore they take up a pressure differential only. Moreover, it is to be noted that such a construction does not require a heat insulation material to be applied on the partition walls, because overall heat losses to the atmosphere are decreased.

According to the invention the partition walls may extend along the whole length of a frame portion holding the tubes. Such partition walls permit the problem of thermal expansion to be approached in a simple way, since there is no connection between the portions of the housing and the partition walls that have different coefficients of thermal expansion. Heretofore this problem has been a very complicated one because of elevated means temperatures of the walls of the housing and the frame, the temperatures being dependent of those of the media in heat exchange.

When the heat exchanger of the invention is used for heating or cooling a gas in a vertically moving compact bed of heat-transfer media it is advisable that the ratio of cross-sectional area of the housing to that of the frame be at least 2:1.

In the latter case it is advisable that the side walls of the frame be held against the walls of the housing by diametrically opposed sealing partitions to form the collector and the distribution chambers, each of the sealing partitions comprising at least two side-by-side plates oppositely extending in the radial direction from the housing and the frame respectively in spaced overlap relationship to provide a seal substantially eliminating fluid flow from one chamber to the other, due to thermal expansion of the plates, the housing walls and the side walls of the frame.

The provision of the above ratio of the cross-sectional area of the housing to that of the frame in the heat exchanger of the invention makes it possible to optimize the speeds of, preferably, gaseous media in the chambers. Also, the heat exchanger arrangement according to the invention provides an easy access to the space between the housing and the frame to, accordingly, improve conditions for repairs.

BRIEF DESCRIPTION OF THE DRAWINGS

Now the invention will be more fully described, by way of example, with reference to the accompanying drawings, in which.

DESCRIPTION OF THE PREFERRED EMBODIMENTS

Figure 1:
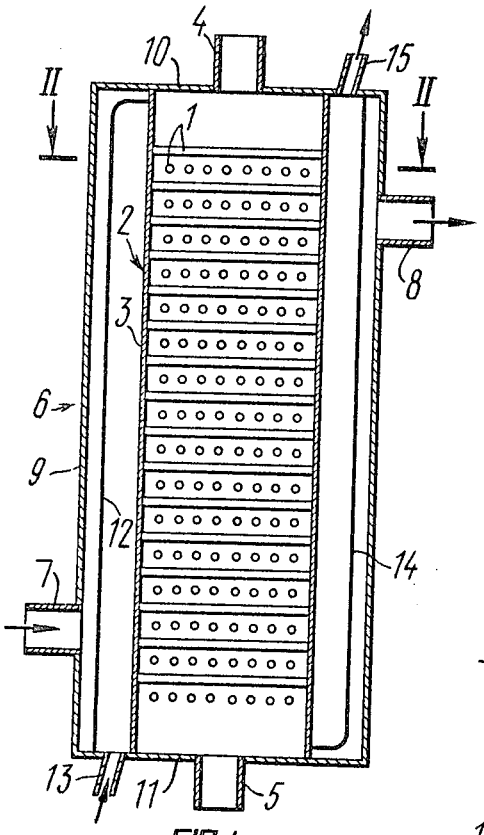
FIG. 1 is a diagrammatical representation of a heat exchanger according to the invention.

Referring to FIG. 1, a heat exchanger comprise tubes 1 for conducting at least one fluid, e.g. a gas, for heat exchange. The tubes 1 are arranged in side-by-side planes so that the tubes in one plane are transverse to those of the other plane. The present embodiment comprises the tubes arranged parallel in each of the planes and in adjacent planes they are at right angles to one another, the tubes forming rows positioned one above the other in a space latticed structure. The ends of the tubes 1 are held in a frame 2 and more precisely in its side walls 3. The frame 2 is an elongate tubular structure open at two sides to form an inlet 4 and an outlet 5 for the medium that is to be heated or cooled, i.e. another medium for heat exchange. With this embodiment the frame 2 is arranged at right angles to the horizontal though it may be suitably otherwise arranged depending on the heat-transfer medium and may be round, oval, rectangular or of any other suitable shape in cross-section, presently being square-shaped.

The frame 2 is enclosed by a housing 6 having an inlet 7 and an outlet 8 for the former medium for heat exchange. The housing 6 as illustrated herein is of a round cross section, i.e. it is a cylinder having side walls 9, an upper end wall 10, and a lower end wall 11.

The diametrically opposed longitudinal edges of the frame 2 are engaged with the side walls 9 of the housing 6 by sealing partitions, thereby dividing the space defined by the walls of the housing 6 and the frame 2 into a collector a and a distribution b chambers. The chambers a and b together with the inlet 7 and the outlet 8 as well as with the tubes 1 form a flow path for the former medium for heat exchange.

Figure 2:
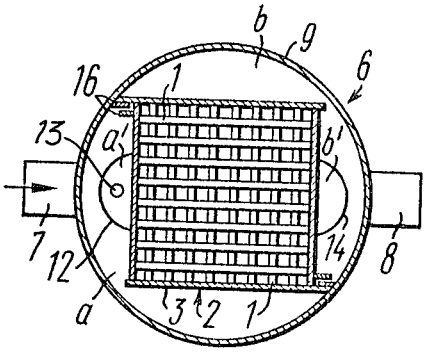
FIG. 2 is a cross-sectional view taken along the line 2—2 in FIG. 1 of one embodiment of the invention.

Within the collector chamber a and along a portion of the side wall 3 of the frame 2 arranged is a partition wall 12 which is a shaped sheet or plate. With the present embodiment the partition wall 12 is arcuate in cross section, i.e., it is a semicylinder. A preferred partition wall extends along the whole portion of the frame 2 where the tubes 1 are held. As can be seen in FIGS. 1 and 2 the edges of the partition wall 12 are attached to the side wall 3 whereby the partition wall 12 divides the chamber a into two spaces to thereby form a further collector chamber a' and separate a portion of the tubes 1. The chamber a' has its own inlet 13 for a medium for heat exchange.

Within the distribution chamber b arranged in a similar manner is a similar partition wall 14 forming a further distribution chamber b' from which the medium is withdrawn through an outlet 15.

The chambers a' and b' together with the inlet 13 and the outlet 15 as well as with the portion of the tubes 1 separated by the partition walls 12 and 14 form a further flow path for one of the media for heat exchange.

When the heat exchanger of the invention is used for heating or cooling a gaseous medium it is necessary that the flow path for the medium be relatively large in cross section, which is presently expressed as a ratio of cross-sectional area of the housing 6 to that of the frame 2, which is 2:1. To provide engagement of the frame 2 with the housing 6 the sealing partitions comprise at least two side-by-side plates 16 each. One of the plates 16 is secured to the housing 6 and is extending radially toward the frame 2. The other plate 16 is secured to the frame 2 and is extending radially in spaced side-by-side relationship with the former plate. The extremities of each of the plates 16 in a pair of the plates are not in contact with the housing and the frame respectively providing an amount of overlap and together with the spacing between the side-by-side plates forming a Z-shaped spacing. The amount of the spacing is such that due to thermal expansion of the plates 16, the housing walls 9, and the frame side walls 3 a seal is provided to substantially eliminate fluid flow from one chamber to the other.

Figure 3:
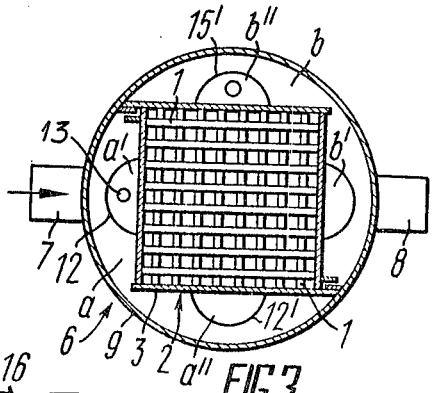
FIG. 3 is a cross-sectional view similar to that in FIG. 2 but illustrating an alternative embodiment.
Figure 4:
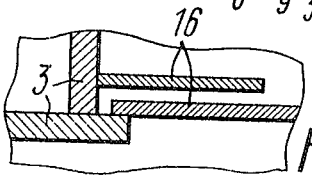
FIG. 4 is an enlarged view showing how the housing engages the frame.

As can be seen in FIG. 3, the heat exchanger of the invention may be constructed in a similar manner but to form a further flow path for fluid (for example a third one) for heat exchange.

Now the heat exchange will be described in operation, by way of example, as used for heating air in shale ashes from the process for the continuous retorting of oil shale.

The medium, which is to be cooled, in this instance hot shale ashes, moves down through the inlet 4 into the passage of the frame 2 and passes over the tubes 1 down to the outlet 5 to be removed from the exchanger. At the same time air, which is to be heated is passed through the tubes 1. The air is delivered into the heat exchanger through a corresponding inlet depending on the number of flow paths for separate media provided in the exchanger and is conducted via a corresponding collector chamber to corresponding tubes to be heated there to a predetermined temperature and further on it is conducted to a user via a corresponding distribution chamber. An air flow rate through each path is determined on the number of tubes 1 included in a flow path and on the optimum speed of the air through the tubes.

What is claimed is:

1. A heat exchanger comprising:

a plurality of tubes arranged in at least two side-by-side vertically adjacent planes to carry at least one fluid for heat exchange, axes of tubes in one plane being transverse to axes of tubes in a next vertically adjacent plane;

an elongate frame for said tubes open at two sides to form an inlet and outlet for the medium that is to be heated or cooled and having side walls in which the ends of said tubes are held;

a housing having wall means including side wall means and end wall means, said housing surrounding said frame and having an inlet and outlet for at least one fluid for heat exchange, said housing engaging said frame with the wall means of said housing and the side walls of said frame defining collector and distribution chambers intercommunicating through one portion of said tubes;

at least one first partition wall made of a shaped plate arranged within said collector chamber along a portion of the side wall of said frame and attached on the edges thereof to said portion of the frame side wall and defining with the same portion of the frame side wall at least one further collector chamber communicating with another portion of said tubes and having an inlet for one of at least one fluid for heat exchange; and at least one second partition wall made of a shaped plate arranged within said distribution chamber along a portion of the side wall of said frame and attached on the edges thereof to said portion of the frame side wall and defining with the same portion of the frame side wall at least one further distribution chamber communicating through said another portion of said tubes with said at least one further collector chamber and having an outlet for one of at least one fluid for heat exchange, wherein each one of the first and second partition walls extend in a direction substantially perpendicular to the axis of the tubes in the vertically adjacent planes along substantially the whole length of the frame holding the tubes, is secured only to said frame along the length thereof, and is free of contact with said housing side wall means.

2. A heat exchanger as in claim 1 wherein each first and second partition walls are arcuate in cross section.

3. A heat exchanger as in claim 1 comprising a further first and a further second partition walls both respectively defining a further collector chamber having an inlet for one of at least one fluid and a further distribution chamber having an outlet for one of at least one fluid, said collector chamber being in communication with said distribution chamber via a third portion of the tubes.

4. A heat exchanger as in claim 1 wherein the ratio of cross-sectional area of the housing to that of the frame is at least about 2:1.

5. A heat exchanger as in claim 4 wherein the side walls of the frame are held against the wall means of the housing by diametrically opposed sealing partitions to form the collector and the distribution chambers, each of the sealing partitions comprising at least two side-by-side plates oppositely extending in the radial direction from the housing and the frame respectively in spaced overlap relationship to provide a seal substantially eliminating fluid flow from one chamber to the other due to thermal expansion of the plates, the housing wall means, and the side walls of the frame.

6. The heat exchanger of claim 5 which is adapted to convey medium through said inlet and outlet of said frame in a substantially downwardly direction.

7. The heat exchanger of claim 6 adapted to convey medium of loose material in the form of a compact, substantially vertically-moving bed through said inlet and outlet of said frame.

8. In a heat exchanger comprising a plurality of tubes to carry a fluid medium for heat exchange;

an elongate frame for said tubes, open at two sides to form an inlet and outlet for a second fluid medium, and having wall means in which the ends of said tubes are supported; and a housing surrounding said frame and having an inlet and outlet for the first fluid medium, said housing having wall means for engaging said frame with said frame wall means and said housing wall means defining collector and distribution chambers intercommunicating through said tubes;

the improvement wherein:

the wall means of the frame are held against the wall means of the housing by diametrically opposed sealing partitions to form the collector and the distribution chambers, each of the sealing partitions comprising at least two-side-by-side plates oppositely extending in the radical direction from the housing and the frame respectively, in spaced overlapped relationship to provide a seal substantially eliminating fluid flow from one chamber to the other due to thermal expansion of the plates, the housing wall means, and the wall means of the frame.

* * * * *